United States Patent [19]

Cassarino

[11] 4,299,095

[45] Nov. 10, 1981

[54] DEFROST SYSTEM

[75] Inventor: A. Victor Cassarino, Newington, Conn.

[73] Assignee: Robertshaw Controls Company, Richmond, Va.

[21] Appl. No.: 66,349

[22] Filed: Aug. 13, 1979

[51] Int. Cl.[3] ..... F25D 21/06; G05D 23/32

[52] U.S. Cl. ..... 62/155; 62/156; 62/158

[58] Field of Search ..... 62/158, 151, 155, 156, 62/128, 140

[56] References Cited

U.S. PATENT DOCUMENTS

| | | | |
|---|---|---|---|
| 3,273,635 | 9/1966 | Jobes | 62/154 X |
| 3,282,065 | 11/1966 | Flanagan | 62/140 |
| 3,400,553 | 9/1968 | Orbesen | 62/155 |
| 3,453,837 | 7/1969 | Sandstrom et al. | 62/140 |
| 3,461,681 | 8/1969 | Smith et al. | 62/81 |
| 3,466,888 | 9/1969 | Kyle | 62/156 |
| 3,529,659 | 9/1970 | Trask | 165/29 |
| 3,681,933 | 8/1972 | Check, Jr. | 62/156 |
| 3,777,505 | 12/1973 | Otaki | 62/81 |
| 3,918,268 | 11/1975 | Nussbaum | 62/150 |
| 3,950,962 | 4/1976 | Odashima | 62/156 |
| 4,007,603 | 2/1977 | Gustafsson | 62/151 |
| 4,024,722 | 5/1977 | McCarty | 62/81 |
| 4,027,497 | 6/1977 | Thurman | 62/156 |
| 4,028,593 | 6/1977 | Newell | 62/158 |
| 4,167,858 | 9/1979 | Kojima et al. | 62/129 |

*Primary Examiner*—William E. Wayner
*Assistant Examiner*—Harry Tanner
*Attorney, Agent, or Firm*—Harold W. Adams

[57] ABSTRACT

A defrost system for refrigeration units, particularly heat pumps, is described. Features include means for initiating a defrost cycle upon the concurrence of two sensed conditions, and terminating the defrost cycle either on the lapse of a determined time interval or the occurrence of a sensed condition, whichever occurs first. Delay timer means prohibits consecutive defrost cycles or a defrost cycle upon restoration of power in the event of a power failure. Means are also provided permitting short cycle testing of the system.

6 Claims, 2 Drawing Figures

ELECTRONIC DE-ICE CONTROL TIMING CYCLE

A

B

DEFROST SYSTEM

BACKGROUND OF THE INVENTION

1. Field of the Invention

The invention relates to demand defrost systems for use with refrigeration units, particularly heat pumps used in both a heating and cooling mode.

2. Description of the Prior Art

Heat pump systems designed to both heat and cool an enclosed space are well known in the prior art. Briefly, these systems consist of a compressor connected by means of a reversing valve between exterior and interior coils which serve as the evaporator and condenser, respectively, when the system is operating in the heating cycle. Heat is exchanged between the refrigerant in the coils and the stream of air blown over each by separate fans.

The exterior coil extracts heat from the exterior air and the interior coil gives it up to the interior air blown over it, both coils thus serving as heat exchangers using a conventional refrigerant as the medium. This heat exchange cycle is reversed when the heat pump is operated in a cooling mode. Typical of such heat pump systems are those shown and described in U.S. Pat. Nos. 4,007,603, 3,950,962, 3,024,722, 3,918,268, 3,400,553, 3,461,681, 3,466,888, 3,529,659, 3,681,933, 3,453,837, and 4,027,497 (copies of which are filed herewith).

As shown in the noted patents, the need to sense and remove frost from the exterior coils (heat source side) when the heat pump is operated in the heating mode to improve heat transfer from the exterior air to the refrigerant has long been recognized. This is particularly troublesome when such heat pump systems are operated in geographical locations where the exterior air temperature is frequently below freezing and the humidity is relatively high.

A variety of approaches have been taken to solve the problem of efficiency robbing frost buildup on the exterior coils. One, as shown in U.S. Pat. No. 3,529,659, simply stops the compressor when there is insufficient exterior radiant heat to prevent frost buildup. An electrical heater is used to replace the interior heat lost by stopping the heat pump.

In U.S. Pat. No. 4,027,497 it is proposed that the refrigerant be heated just prior to entry into the exterior coil to prevent frost buildup on the coil. In U.S. Pat. No. 3,918,268 an auxiliary outdoor coil is used with the exterior coil to prevent the exterior surface subject to frost buildup from falling below freezing.

Timed defrost cycles also have been employed; and while generally effective, such systems are frequently initiated when unneeded, a distinct disadvantage when defrosting is accomplished by using the hot gaseous refrigerant, thus necessitating the unnecessary shutting down of the heating system, a real energy expensive annoyance in cold weather. To avoid this, so-called demand defrost systems have been devised using a number of different methods of initiating the defrost cycle when the frost on the exterior coil has built up to the point where it materially lessens the transfer of heat from the exterior air into the refrigerant.

For instance, U.S. Pat. No. 3,453,837 discloses the concept of initiating a defrost cycle upon the occurrence of a predetermined difference in the temperature of air entering and leaving the condenser. The defrost cycle is terminated when the evaporator coil temperature reaches a determined value.

U.S. Pat. Nos. 3,950,962; 3,681,933, 3,466,888; 3,777,505; 3,400,553 and 4,024,722 disclose the use of temperature sensors, singly or in combination, to initiate and terminate the defrost cycle. As observed in U.S. Pat. No. 3,950,962, a disadvantage of so-called "temperature-difference" defrost systems is that strong, continuous or gusty winds can effect the exterior temperature to be sensed. This has frequently been found to effect both the proper initiation and termination of the defrost cycle.

U.S. Pat. Nos. 3,461,681 and 4,007,603 disclose yet other demand defrost systems that include means for sensing and utilizing both temperature and the pressure differentials across the exterior coil to initiate and terminate the defrost cycle. These pressure-difference systems are also subject to faulty operations caused by strong gusts of wind.

A commercially available demand defrost control that initiates a defrost cycle on sensing a pressure differential through an evaporator coil and terminates upon sensing a determined temperature of the coil is the Model DS 10 Series Demand Defrost Control manufactured by the Robertshaw Controls Company, 1701 Byrd Avenue, the assignee of this application.

SUMMARY OF THE INVENTION

The invention is an electrical system for defrosting a heat exchange coil of a refrigeration unit including means for initiating a defrost cycle upon the concurrence of two sensed conditions and for terminating the defrost cycle upon the lapse of a determined time interval or upon a change in one of said sensed conditions, whichever should occur first. Delay means prohibit consecutive defrost cycles or a defrost cycle upon restoration of Power Means are also provided permitting short cycle testing of the system.

BRIEF DESCRIPTION OF THE INVENTION

While the preferred embodiment of the invention is shown as a demand defrost system for use with a heat pump, it is to be understood the invention may also be used to defrost the evaporator coils of air conditioners and other refrigeration units.

As illustrated by conventional demand defrost controls such as the aforementioned Model DS-10 control manufactured by the Robertshaw Controls Company, a differential pressure sensor senses the pressure drop in the stream of air blown across an exterior coil of a heat pump to initiate a defrost cycle. Defrost may be accomplished by reversing the flow of refrigerant through the system to warm the exterior coil or by energizing an electrical heater adjacent the exterior coil.

When the frost melts and the temperature at the coil reaches a determined level; the defrost cycle is terminated. Thus, conventional defrost control systems utilize a pressure sensor to initiate the defrost cycle.

Figure 1:
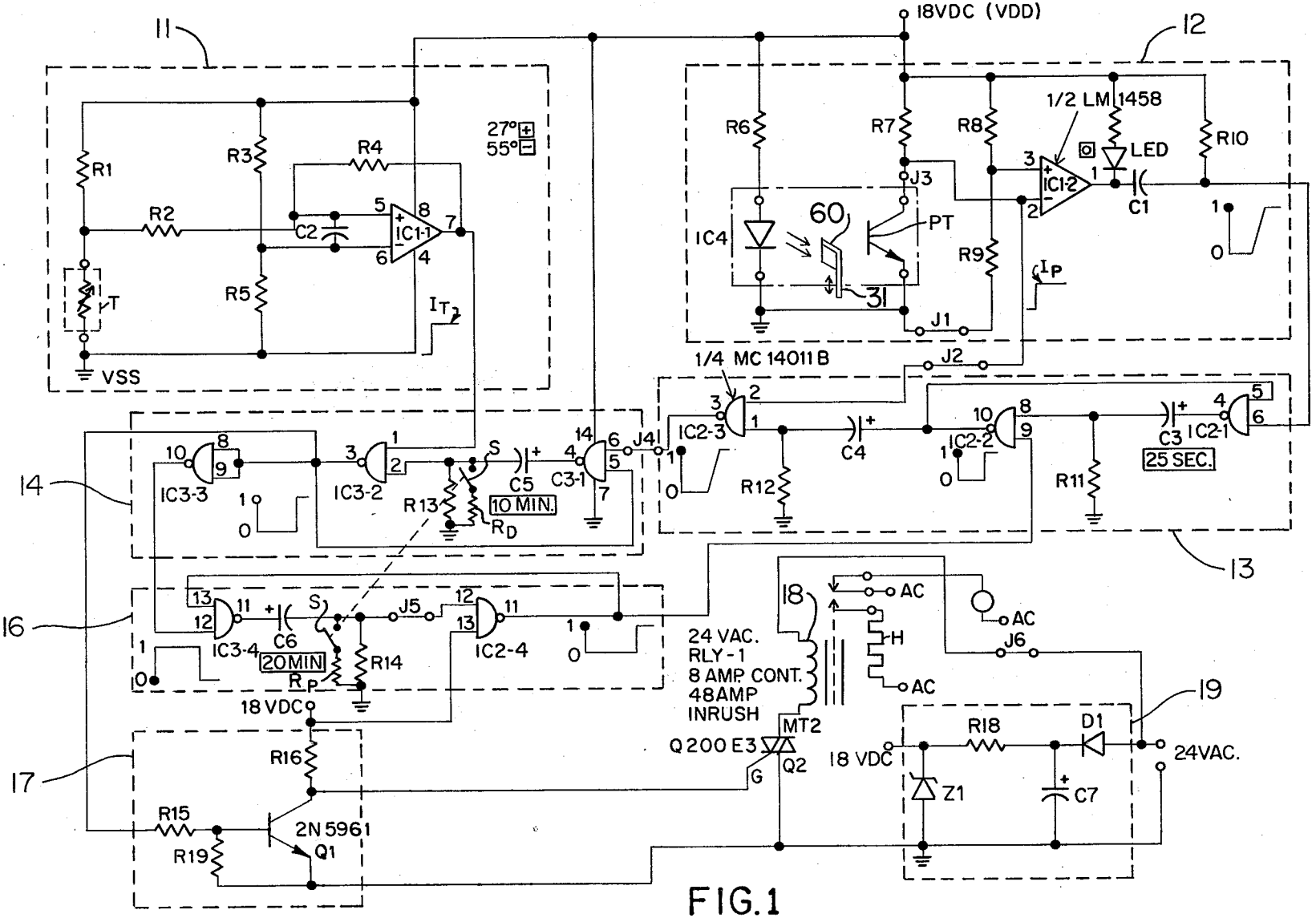
FIG. 1 is an electrical schematic of a preferred embodiment of a demand defrost control system in accordance with the principles of the invention.

In the preferred embodiment of this invention as shown in FIG. 1 both pressure and temperature signals are employed to initiate a defrost cycle and an elapsed time or a determined change in temperature, whichever occurs first, is employed to terminate the cycle. The system also includes delay logic features as well as short cycle means permitting shortened field cycle testing of system operation.

The various components of the circuit shown in FIG. 1 are commercially available and are listed in the following table of contents;

| TABLE OF CONTENTS | |
|---|---|
| | Temperature Sensor 11 |
| $R_1$ | 34.8K |
| $R_2$ | 22 K |
| $R_3$ | 45.3K |
| $R_4$ | 237K |
| $R_5$ | 88.7K |
| T | 30K, Variable Temperature Responsive Resistor |
| $IC_{1-1}$ | Operational amplifier (½ LM 1458) |
| | Pressure Sensor 12 |
| $IC_4$ | Optional Isolator Switch |
| $R_7$ | 150K |
| $R_8$ | 150K |
| $R_9$ | 150K |
| $R_{10}$ | 27K |
| $C_1$ | .047UF |
| $IC_{1-2}$ | Operational Amp - ½ LM1458 |
| | Inhibitor 13 |
| $IC_{2-1}$ | Gate MC14011B |
| $IC_{2-2}$ | Gate MC14011B |
| $IC_{2-3}$ | Gate MC140118 |
| | Defrost Timer 14 |
| $C_5$ | 47MF |
| $R_{13}$ | 12.1M |
| $IC_{3-1}$ | Gate MC140118 |
| $IC_{3-2}$ | Gate MC140118 |
| $IC_{3-3}$ | Gate MC140118 |
| | Delay Timer 16 |
| $C_6$ | 100MF |
| $R_{14}$ | 12.1M |
| $IC_{3-3}$ | Gate MC14011B |
| $IC_{2-4}$ | Gate MC14011B |
| | Driver 17 |
| $R_{15}$ | 150K |
| $R_{16}$ | 1.5K |
| $R_{19}$ | 33K |
| $Q_1$ | 2N5961 |
| | Output 18 |
| | Power Supply 19 |
| Input | 24VAC |
| $D_1$ | IN4004 |
| $C_7$ | 100MF |
| $R_{18}$ | 330 OHM |
| $Z_1$ | IN5248 Zener Diode |
| 18VDC | Outputs |

Figure 2:
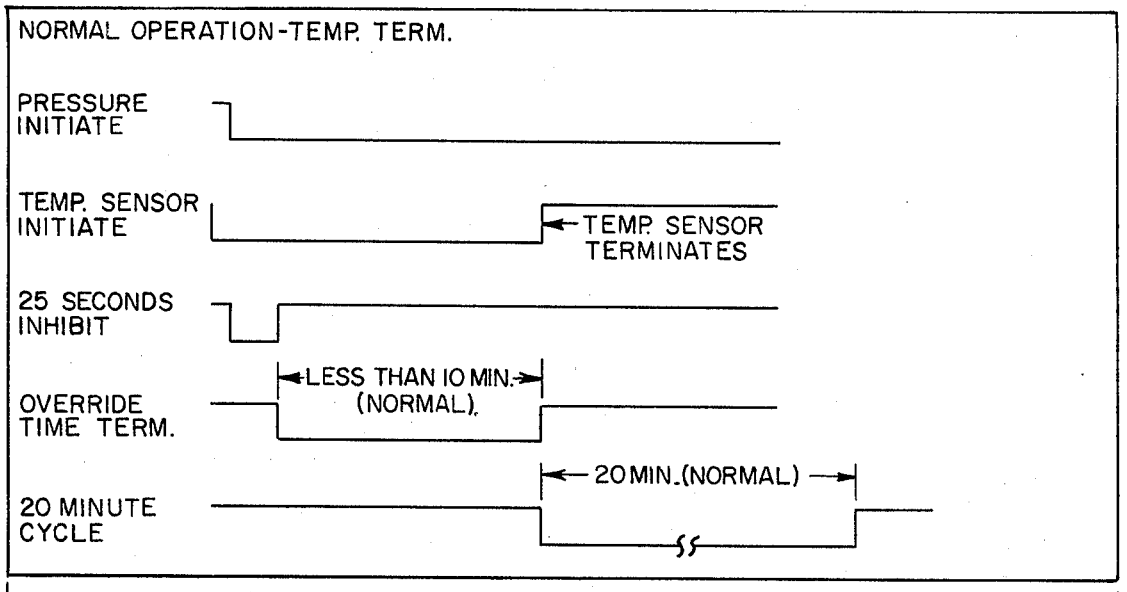
FIG. 2 is a diagram illustrating the timing cycles of the operating modes of the system shown in FIG. 1.
Figure 2:
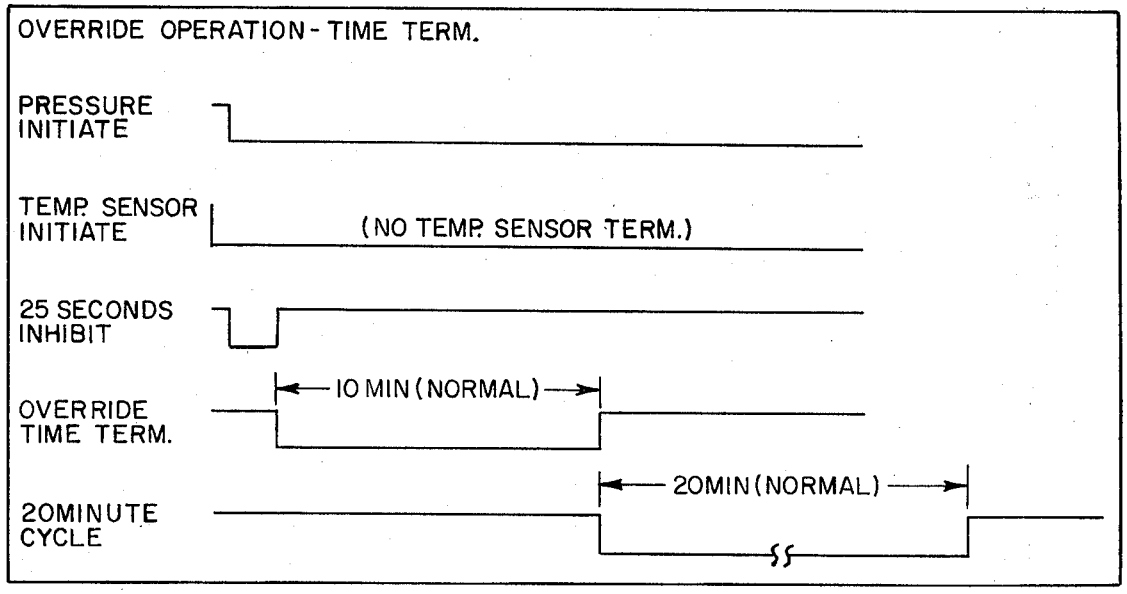

The preferred embodiment of the invention as employed in a demand defrost system for a conventional heat pump can best be described by explaining the operation of the circuit shown in FIG. 1 in conjunction with the timing cycles of FIG. 2.

In normal operation when a falling outdoor temperature goes below a selected value such as 27 degrees F., temperature sensor 11, a conventional resistance bridge network including a thermistor T having a negative temperature coefficient, is arranged to change the ouput state of operational amplifier $IC_{1-1}$ at pin 7 from negative to positive to apply a continuous, positive, temperature initiate signal $I_t$ to pin 1 of gate IC3-3 until the temperature returns to a determined higher value, in this instance 55 degrees F. At that time the output of operational amplifier $IC_{1-1}$ again changes state going negative.

The operating temperature range of the system for a given resistance bridge network ($R_1$, $R_3$ and $R_5$) may be varied by adjusting the value of thermistor T and of the differential feed back resistor $R_4$ as is well known. $R_2$ serves as an input resistor and $C_2$ as a decoupler.

Simultaneously with this temperature sensing, the pressure sensor 12 is arranged to sense frost buildup on the exterior coil of the heat pump (not shown) until the light beam of the optical isolator switch $IC_4$ is interupted by the vane 60 of a movable pin 31 of a differential pressure frost sensor. Such a frost sensor is described and shown in detail in the co-pending U.S. Patent application, Ser. No. 094,907 Filed Sept. 17, 1979, entitled Control Device and Method of Making Same in which Charles J. Everett is the inventor and of which the assignee of record is the same as that of this application. With the aforementioned co-pending patent application incorporated herein by reference, it is believed the operation of differential pressure frost sensors of the type employed here is sufficiently clear to obviate the need for a further detailed description.

Suffice it to say that the photo transistor PT in pressure sensor 12 conducts holding the output of operational amplifier $IC_{1-2}$ positive until the light beam is interrupted by the vane 60. At that time, it is turned off signalling a determined change in pressure across the exterior evaporator coil of the heat pump. As will be explained this change in pressure may possibly be caused by brief wind gusts as well as frost buildup on the evaporator coils.

When photo transistor PT turns off, the output of operational amplifier $IC_{1-1}$ goes negative lighting the LED signifying a pressure-initiate signal and applying a microsecond negative pulse, the interval of which is determined by the time constant of the $R_{10}$ $C_1$ network, to pin 6 of one shot interverter gate $IC_{2-1}$ of the inhibitor 13. At the same time, a positive signal is applied from pin 2 of operational amplifier $IC_{1-2}$ to pin 2 of one shot inverter gate $IC_{2-3}$. Feedback from pin 10 of gate $IC_{2-2}$ latches gate $IC_{2-1}$ on during the charging interval of the $R_{11}$ $C_3$ network, in this instance 25 seconds.

Pin 10 of gate $IC_{2-2}$ goes positive upon the expiration of the 25 second inhibit interval to operate inverter gate $IC_{2-3}$ providing pin 2 of $IC_{2-3}$ is still positive as it would be in the event of an undersirable frost buildup on and a change in pressure across the exterior evaporator coils. If the pressure initiate or positive signal $I_P$ is applied to pin 2 of gate $IC_{2-3}$ from pin 2 of $IC_{1-2}$ for less than the inhibit interval of 25 seconds, such as might occur because of a strong but short wind gust across the exterior coil, a defrost cycle is not initiated. The LED will remain on so long as the pressure initiate signal $I_P$ is present.

With both pins 1 and 2 positive, gate $IC_{2-3}$ operates applying a negative pulse to pin 6 of one shot inverter gate $IC_{3-1}$ of defrost timer 14. Gates $IC_{3-1}$ and $IC_{3-2}$ cooperate in the same fashion as gates $IC_{2-1}$ and $IC_{2-2}$ for a defrost interval determined by the time constant of the $R_{13}C_5$ network in this instance 10 minutes. During this interval the negative output of $IC_{3-2}$ is applied to the base of transistor $Q_1$ in the driver 17, causing its output to go positive. This biases triac $Q_2$ into conduction energizing relay 18 which closes its contacts to turn on heater H to commence a defrost cycle.

The relay 18 could be employed to operate a reversing valve to turn off an exterior fan and to reverse the flow of refrigerant in the heat pump system. This turns off the heating system fan in the interior space to be warmed entirely however so that repeated defrost cycles may permit execessive interior cooling.

Upon the expiration of the 10 minute defrost interval or the removal of the positive temperature initiate signal $I_t$ signal from pin 1 of gate $IC_{3-2}$ signifying that the temperature sensed by thermister T has exceeded 55 degrees F., whichever occurs first, gate $IC_{3-2}$ operates to pulse one shot gate $IC_{3-3}$ to setoff a delay timer 16 which operates in essentially the same manner as the defrost and inhibit timers, gate $IC_{2-4}$ serving to latch gate $IC_{3-4}$ on during a delay interval determined by the time constant of the $R_{14}C_6$ network, in this instance 20 minutes.

During the delay interval a negative signal applied to pin 9 of gate $IC_{2-2}$ overrides the inhibitor 13 enforcing a 20 minute delay interval between defrost cycles. Delay timer 16, because of its gain, is also arranged to enforce a 20 minute delay interval following a restoration of electrical power regardless of what mode of operation or timing cycle the system might have been in at the time of the power failure.

Referring to FIGS. 2A and B the sensed condition requirements to initiate a defrost cycle in either a normal temperature terminate mode or in a time override mode are shown. In both instances a 20 minute delay interval is enforced between defrost cycles.

In the manufacture of demand defrost control systems in accordance with a preferred embodiment of the invention, circuit components are selected to provide the desired temperature range, change in pressure representing frost buildup, and the inhibit, defrost, and delay intervals to meet a particular users requirements. With defrost and delay intervals such as described of 10 and 20 minutes respectively, field testing of such a system in the event servicing is required, means a 30 minute wait for the serviceman to see if the defrost system cycles properly with the circuit thus far described.

To permit short cycle testing of the system, assuming both the temperature sensor 11 and the pressure sensor 12 are activated as by shorting the thermistor T by means of a switch or the like and interrupting the light beam in the pressure sensor to light the LED and provide the necessary temperature and pressure initiate signals, $I_t$ and $I_p$, circuit means may be provided to shorten one or both of the defrost and delay intervals.

This is achieved by placing a smaller resistance $R_p$ in parallel with each of the resistances $R_{13}$ and $R_{14}$ to shorten the time constant of the respective $R_{13}C_5$ and $R_{14}C_6$ networks. The resistances $R_p$ may be selectively added in the respective circuits by closing separate, normally open switches S. The switches S may also be arranged to form a double pole double throw switch, so as to be operated simultaneously. The short cycle defrost and delay time intervals can thus be shortened as desired, thus facilitating field servicing.

While a preferred embodiment of a defrost system for use in a heat pump in accordsnce with the invention has been described in detail it is to be understood the invention may be used in a demand defrost system for all types of refrigerating units in which the detection and removal of frost in the manner as described herein is required. Accordingly, it is intended that the invention be limited only to the scope of the appended claims.

What is claimed is:

1. A system for defrosting a refrigeration unit wherein heat is exchanged between refrigerant in a heat exchange means and a stream of air directed over said heat exchange means comprising:

means for sensing a determined temperature of said heat exchange means and providing a temperature signal representative thereof;

means for sensing a determined change in pressure in said stream of air over said heat exchange means caused by frost thereon and providing a pressure signal representative thereof;

means for heating said heat exchange means to melt frost thereon defrosting same;

and timing means for actuating said heating means thereby initiating a defrost cycle only upon the simultaneous occurrence of said temperature and pressure signals for a determined interval and for thereafter terminating said defrost cycle upon the lapse of a determined interval or upon a determined change in said temperature signal whichever condition occurs first.

2. The system as defined in claim 1 including delay timer means for preventing the reoccurrence of a defrost cycle during a delay interval determined by said delay timer means.

3. The system as defined in claim 1 wherein said heater means is mounted adjacent said heat exchange means and including driver means responsive to said defrost timer means for operating said heater means during said defrost cycle.

4. The system as defined in claim 1 including a power supply.

5. The system as defined in claim 2 including short cycle means for shortening said defrost and delay time intervals.

6. The system defined in claim 5 wherein said defrost and delay timer means include RC time constant networks and said short cycle means includes circuit means for reducing the time constant of said RC time constant networks.

* * * * *